US008353099B2

(12) United States Patent
Münster et al.

(10) Patent No.: US 8,353,099 B2
(45) Date of Patent: Jan. 15, 2013

(54) INSERTION AID FOR LOADING NEEDLE BOARDS

(75) Inventors: Bernhard Münster, Messstetten (DE); Eckhard Fehrenbacher, Tübingen (DE)

(73) Assignee: Groz-Beckert KG, Albstadt (DE)

( * ) Notice: Subject to any disclaimer, the term of this patent is extended or adjusted under 35 U.S.C. 154(b) by 407 days.

(21) Appl. No.: 12/729,691

(22) Filed: Mar. 23, 2010

(65) Prior Publication Data

US 2010/0242266 A1 Sep. 30, 2010

(30) Foreign Application Priority Data

Mar. 27, 2009 (EP) ..... 09156528

(51) Int. Cl.
*B23P 21/00* (2006.01)
*B25B 27/14* (2006.01)
*D04H 18/00* (2012.01)

(52) U.S. Cl. ..... 29/721; 29/281.1; 28/115

(58) Field of Classification Search ..... 29/700, 29/721, 281.1; 28/115, 299
See application file for complete search history.

(56) References Cited

U.S. PATENT DOCUMENTS

| | | | |
|---|---|---|---|
| 4,260,047 | A | 4/1981 | Nels |
| 4,568,010 | A | 2/1986 | Dilo |
| 4,936,497 | A | 6/1990 | Ordelt |
| 6,393,693 | B1 | 5/2002 | Finocchi |
| 2008/0184546 | A1 | 8/2008 | Munster |

FOREIGN PATENT DOCUMENTS

| | | |
|---|---|---|
| DE | 1923665 | 9/1965 |
| DE | 3201282 | 7/1983 |
| DE | 8329050 | 1/1984 |
| DE | 8512596 | 6/1985 |
| DE | 3743979 | 6/1989 |
| DE | 10231637 | 1/2004 |
| EP | 07002360 | 2/2007 |
| FR | 2516804 | 5/1983 |
| GB | 1296725 | 11/1972 |
| JP | 2001244323 | 4/2001 |
| SU | 412325 | 1/1974 |

*Primary Examiner* — John C Hong
(74) *Attorney, Agent, or Firm* — Fitch, Even, Tabin & Flannery, LLP

(57) ABSTRACT

An insertion arrangement (20) is provided to make it easier for an operator to insert several needles (41, 44) clamped in a multiple clamping chuck (40), even in the case of certain positional deviations, simultaneously in the associate bores (11) of a needle board (10). The insertion arrangement (20) comprises a guide section (32) with many parallel grooves (51) that are arranged at the distance of the bores (11), and that, respectively, can accommodate the tip (45) of a needle (41, 44) and can guide said tip to the associate bore (11). In so doing, the grooves (51) help align the individual needles (41, 44) with respect to the bores (11) in that the grooves correct potential positional deviations by slightly bending the needles (41, 44). The insertion arrangement (20) is mounted to an automatic loading machine (1) and can be adjusted and locked relative to a needle board (10) accommodated in the automatic loading machine.

15 Claims, 9 Drawing Sheets

INSERTION AID FOR LOADING NEEDLE BOARDS

CROSS-REFERENCE TO RELATED APPLICATION

The present application claims the priority of European Patent Application No. 09 156 528.3, filed Mar. 27, 2009, the subject matter of which, in its entirety, is incorporated herein by reference.

BACKGROUND OF THE INVENTION

The present invention relates to a device for loading needle boards of felting and structuring machines.

Felting machines are disposed for rendering more dense non-woven fabrics of fibers, said fabrics consisting of randomly placed fibers such as, e.g., felts (with and without carrier material), and, optionally, also for post-processing woven and knit fabrics. For this purpose, the felting machines comprise an essentially plane support that is provided with a large number of felting needles. This carrier is also referred to as a needle board. The felting needles are seated in appropriate openings or bores, whereby the needles' holding part is pressed into said openings or bores. The term "felting needle" used herein also comprises needles that are used for post-processing, e.g., for roughening or perforating knit or woven fabrics.

The insertion of the needles in a needle board, as well as the removal of said needles, is a tedious procedure that is frequently performed—in full or in part—by hand. If needles are worn or if the needles of a needle board need to be replaced for other reasons, the old needles must be removed from the needle board and the new needles must be inserted in the needle board. Therefore, in the past, attempts have been made to at least partially automate this process.

Document EP 07 002 360 describes the simultaneous insertion of a number of felting needles in a row of bores of a needle board, said needles being mounted, under tension, parallel to each other at a prespecified distance by means of a multiple clamping chuck. To achieve this, a filling device is provided, said filling device individually providing—with the aid of two parallel-arranged worm conveyors—felting needles from a supply and at a proper distance corresponding to the division of the needle board, so that the needles can be grasped in groups by the multiple clamping chuck and be simultaneously set into the needle board.

Although the described device allows a considerable simplification of the loading process, a need for improvement is indicated. For example needles mounted in the multiple clamping chuck may somewhat deviate from the desired parallel alignment. The reason for this may be that the needles have been gripped not in exact parallel alignment by the multiple clamping chuck or that the needles are slightly curved. As a result of this, deviations regarding the position of individual needle tips may occur within a plane defined by the mounted needles as well as perpendicularly to said plane.

Inasmuch as the needle board bores are very close together, even a minimal positioning error prevents the insertion of a needle in its associate bore. If only a single needle is aligned wrongly, this may prevent the entire group of the needles mounted in the multiple clamping chuck from being inserted together. In order to trouble-shoot this error, manual intervention is necessary, for example, in order to manually align the affected needles or insert them into the needle board. Such complex post-processing delays the loading operation.

Accordingly, it is the object of the invention to enable a fast and reliable insertion of needle groups in a needle board.

SUMMARY OF THE INVENTION

The above object is generally achieved according to the invention with an insertion arrangement Insertion arrangement for the insertion of at least one needle, which is clamped in a multiple clamping chuck, into a needle board having several bores for the accommodation of needles. The insertion arrangement has at least one recess for the accommodation of at least one needle, and the recess is arranged such that it is suitable for guiding the at least one needle into an associated bore of several bores.

In accordance with the present invention, an insertion aid or insertion arrangement for the insertion of several needles in a needle board of a structuring or felting machine is provided. Together, the needles are clamped in a multiple clamping chuck and are preferably arranged next to each other in a row. Preferably, the distance of the needles corresponds to the division or the distance of the associate bores in a needle board, said bores being arranged in a row, in order to completely load said needles. However, it is also possible to select greater needle distances which result in some of the bores to remain unoccupied. Typically, the needle board bores have a narrower diameter in order to securely hold a needle after it has been pressed in. Consequently, the tolerances with respect to the mentioned positional deviations of the tips of the mounted needles are minimal.

The insertion arrangement in accordance with the invention comprises several recesses for the accommodation of respectively one of the needles clamped in a multiple clamping chuck. The recesses represent guide channels that are disposed for guiding respectively one of several needles into its associate bore of the multitude of bores. Preferably, the cutouts are grooves or channels and may have an elongated form and be arranged parallel with respect to each other like the needles. Preferably, the recesses are arranged so as to be equidistant in a first direction at a distance from each other, said distance corresponding to the division of the bores on the associate needle boar. Preferably, the distance corresponds, at the same time, to the distance of adjacent needles in the multiple clamping chuck. However, it is also possible for the divisions to be different from each other, whereby, however, at least each needle is associated with a corresponding recess relative to its guide and a corresponding bore for the insertion of the needle. The insertion arrangement could also have additional recesses at a distance corresponding to another needle board division, so that the insertion arrangement can be used with needle boards displaying a different division.

The cutouts for the accommodation of the needles are preferably grooves that are formed in a surface of the insertion arrangement and preferably extend in the surface up to an edge. The edge may be an edge of a prism-shaped guide section tapering at an acute angle. The angle may be approximately 45 degrees, for example.

Due to such an open-ended groove, the edge of the insertion arrangement may be seated on the needle board. During insertion, the tip of one of the needles clamped in the multiple clamping chuck may be initially received by the groove and subsequently be guided—following the groove—to the bore. During use, the insertion arrangement is preferably arranged so that the corresponding bore of the needle board is a continuation of the groove, in which case the needle is to be inserted into said board. This enables a secure simultaneous transfer of all the needles guided in the respective grooves into the associate bores. The groove stabilizes the needle in horizontal direction against lateral movements within the plane of the surface of the insertion arrangement.

Preferably, the operator, who uses one hand for guiding the multiple clamping chuck, biases the needles at a slight pressure against the bottom of the respective grooves during insertion, so that all the needle tips abut securely—with a slight curvature—against the bottom of the respective groove, despite potential alignment errors. In so doing, the insertion arrangement is preferably arranged and locked in a position so that the groove end is located on the associate bore and that a secure insertion of the needle tip in the bore is achieved when the needle tip has been guided to the end of the groove. The insertion arrangement need not be held by an operator, so that he/she can use the hands for guiding the multiple clamping chuck and for holding or moving the needle board.

The grooves may be configured in many ways. Preferably, they extend parallel and equidistant to each other at a distance that corresponds to the desired division. Preferably, all the grooves are configured in the same manner; however, also different embodiments are possible. The grooves may subsequently be applied as recesses in the surface of a guide section of the insertion device, e.g., by a cutting process. The guide section may consist, e.g., of metal or plastic material. The guide section, including the grooves, could also be made in one piece, e.g., by casting.

Furthermore, the grooves may also be imparted, e.g., by subsequent application of a row of parallel strips on a plane surface of the guide section. The strips may be cut out, e.g., of another element such as a plate. It would also be possible to cut or punch a single preferably comb-shaped structure out of a plate and fasten, e.g., glue, said structure to the surface. In so doing, the guide section in accordance with the invention can be manufactured with many parallel grooves of only two elements, namely a prism-shaped base body and a comb-shaped element.

The grooves may have different configurations. Considering a preferred embodiment, the width of the groove decreases along its length up to the edge of the guide section where the groove ends. In this way, it is achieved that needles—as the multiple clamping chuck approaches the insertion arrangement—are first received by the groove, even if there is a minimal misalignment, and are subsequently forced into the desired position when the needle tips are guided in the direction of the groove end at the edge by the lateral walls of the groove, said position being in alignment with the bore of the needle board. Furthermore, the depth of the grooves may also change along their length toward the edge, preferably become smaller. Considering a preferred embodiment, both the width and the depth of the groove decrease from a large groove cross-section at the beginning for the insertion and secure accommodation of the misaligned needles, while the groove narrows toward the end to a small groove cross-section that essentially accommodates a bore of the needle board.

The grooves may also have different cross-sectional forms. Preferably, a cross-section representing an equilateral triangle or a V is used, said cross-section forming a guide grove channel at a central edge. Due to the narrowing lateral surfaces of the groove, pressure applied to the needles from the top will initially center the needles in the groove center and finally in the bore in the needle board. It is also possible to use trapezoidal cross-sections. Preferably, the width of the plane center section decreases toward the end of the groove in order to achieve a secure alignment of the needle relative to the associate bore.

However, a secure alignment of the needle with the bore can also be achieved with substantially wider grooves, provided they provide a sufficient centering effect. For example, a V-groove of relatively large width and depth may be used in order to be able to securely accommodate needles with tips that are off-position. Due to the central channel, the groove—despite its width—displays an optimal centering effect, so that, also in this case, a secure insertion of the needle in the bore is possible. The same effect can also be achieved with a trapezoidal groove, if the plane central section has only a small width that is preferably not greater than or even clearly smaller than the diameter of the bore. Grooves having a constant cross-section or at least a constant depth can prove to be easier to manufacture. However, semi-circular or pointed-arch-shaped or other groove cross-sections can be used for centering or guiding the needles.

The insertion arrangement in accordance with the invention is preferably used in connection with a needle board receptacle of an automatic loading machine. The insertion arrangement may comprise a ledge that is fastened to the needle board receptacle and extends in longitudinal direction of the needle board. In so doing, the ledge extends preferably parallel to a row of bores of the needle board to be loaded, i.e., in said needle board's longitudinal extension. Due to a suitable arrangement of the ledge relative to the needle board, each of the cutouts may be associated with the bores and, at the same time, facilitate the insertion of a plurality of parallel-arranged needles in their respectively associated bores.

The ledge may have an interchangeable insert or guide section that is associated with a specific type of needle board and is adapted to said board's bore distance and/or bore diameter. Another insert may be held ready for another needle board type. As a result of this, a versatile use of the insertion arrangement is made possible for various geometric configurations of needle boards.

Furthermore, the insertion arrangement may comprise a holder arm that extends in transverse direction of the needle board. The ledge may be held on the holder arm, said ledge extending—in a longitudinal direction—essentially in a direction transverse to the holder arm. The holder arm may be configured to represent a bridge that spans the entire needle board receptacle in transverse direction and is seated or fastened to the opposite side of the needle board receptacle on the housing of the automatic loading machine. Preferably, the holder arm is mounted to the housing of the automatic loading machine so that said holder arm can be slid in longitudinal direction and be locked in the respectively desired position. Alternatively, said holder arm may be permanently connected with the housing, e.g., in the center of the needle board receptacle, whereby—instead of a longitudinal movement of the holder arm—now the needle board must be shifted into the desired position for loading.

The attachment of the ledge to the holder arm may be such that said holder arm can be adjusted in different directions. Preferably, a connection is provided that can be released by the operator in a few manual steps in order to move the ledge relative to the holder and to fix it in place in order to firmly hold the ledge in the desired new position. Preferably, screw elements are used in connection with the manually actuatable rotary handles. It is also possible to use other clamping devices that enable a quick release and fastening of the ledge, and that offer easy adjustability in released state and secure stability in locked position. Preferably, there is a provision for adjustability in transverse direction of the needle board and in height perpendicular to the needle board plane.

Additional details of the invention are obvious from the claims, as well as the description of preferred exemplary embodiments hereinafter with reference to the drawings.

DETAILED DESCRIPTION OF THE INVENTION

Figure 1:
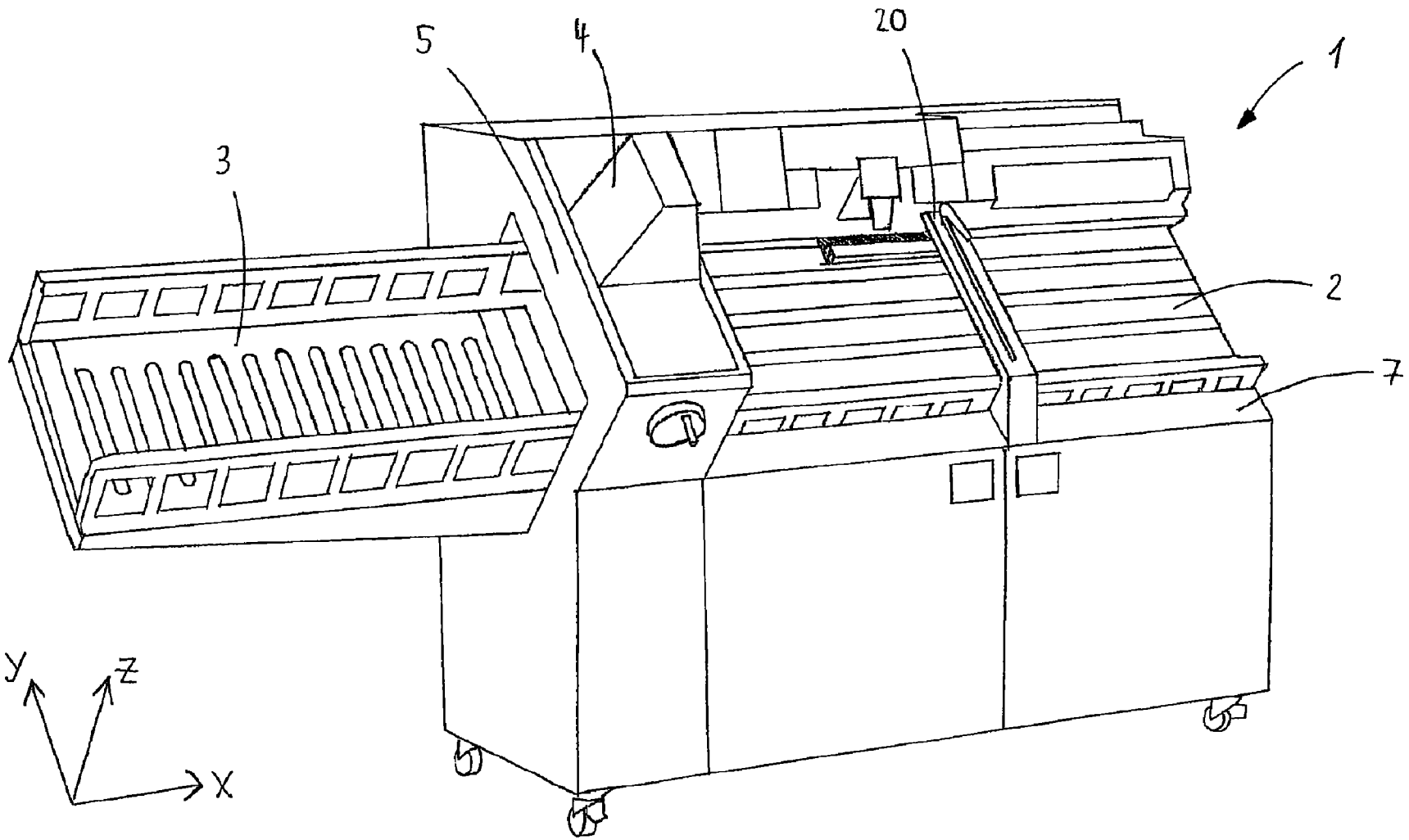
FIG. 1 is a schematic perspective view of an automatic loading machine for loading needles on and for removing needles from the needle boards of felting machines, said automatic loading machine comprising an insertion arrangement in accordance with the invention.

FIG. 1 shows an automatic loading machine 1 for loading needle boards for felting machines. A needle board that is not shown in FIG. 1 is used—after having been loaded—in a felting machine.

Figure 2:
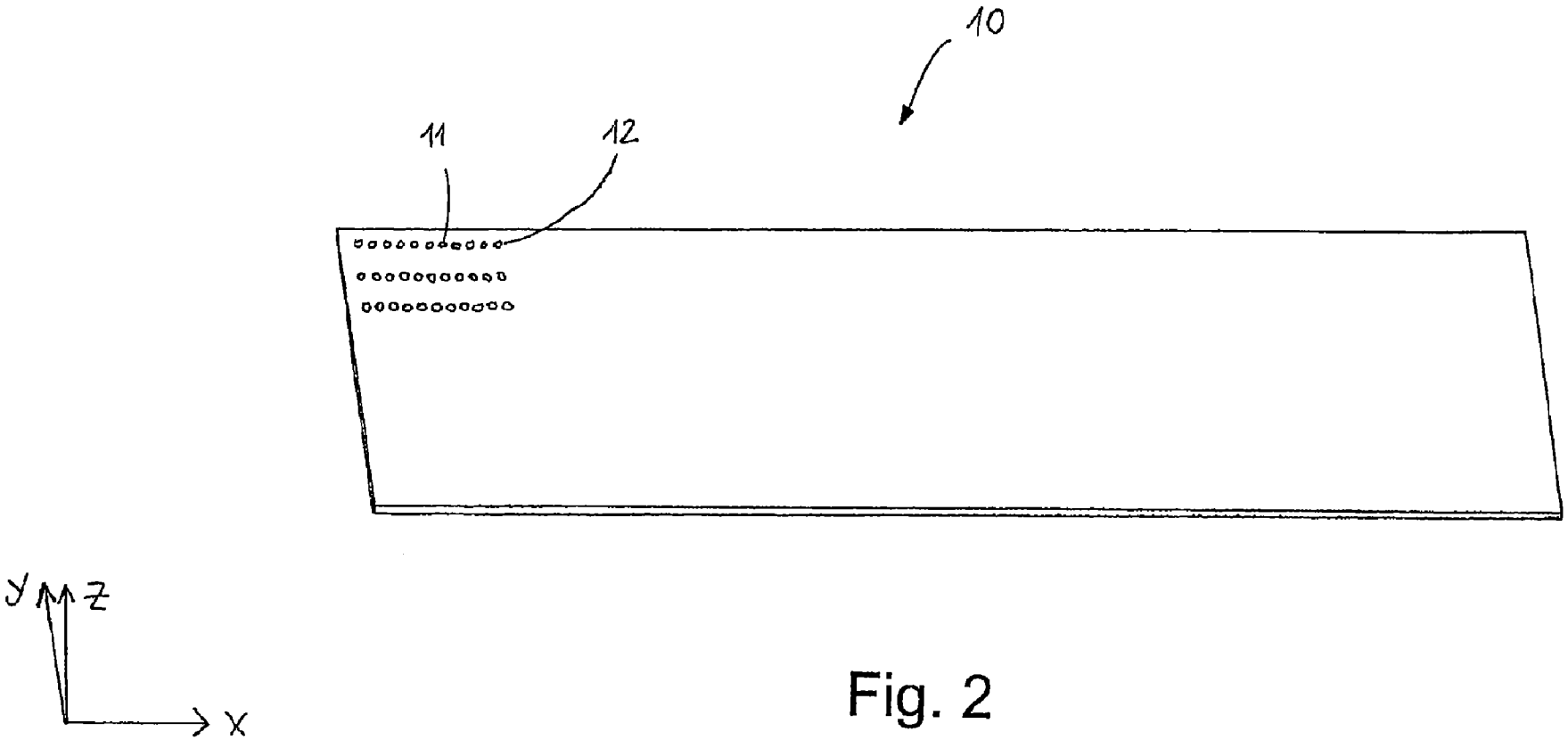
FIG. 2 is a schematic representation of a needle board suitable for the automatic loading machine of FIG. 1.
Figure 8:
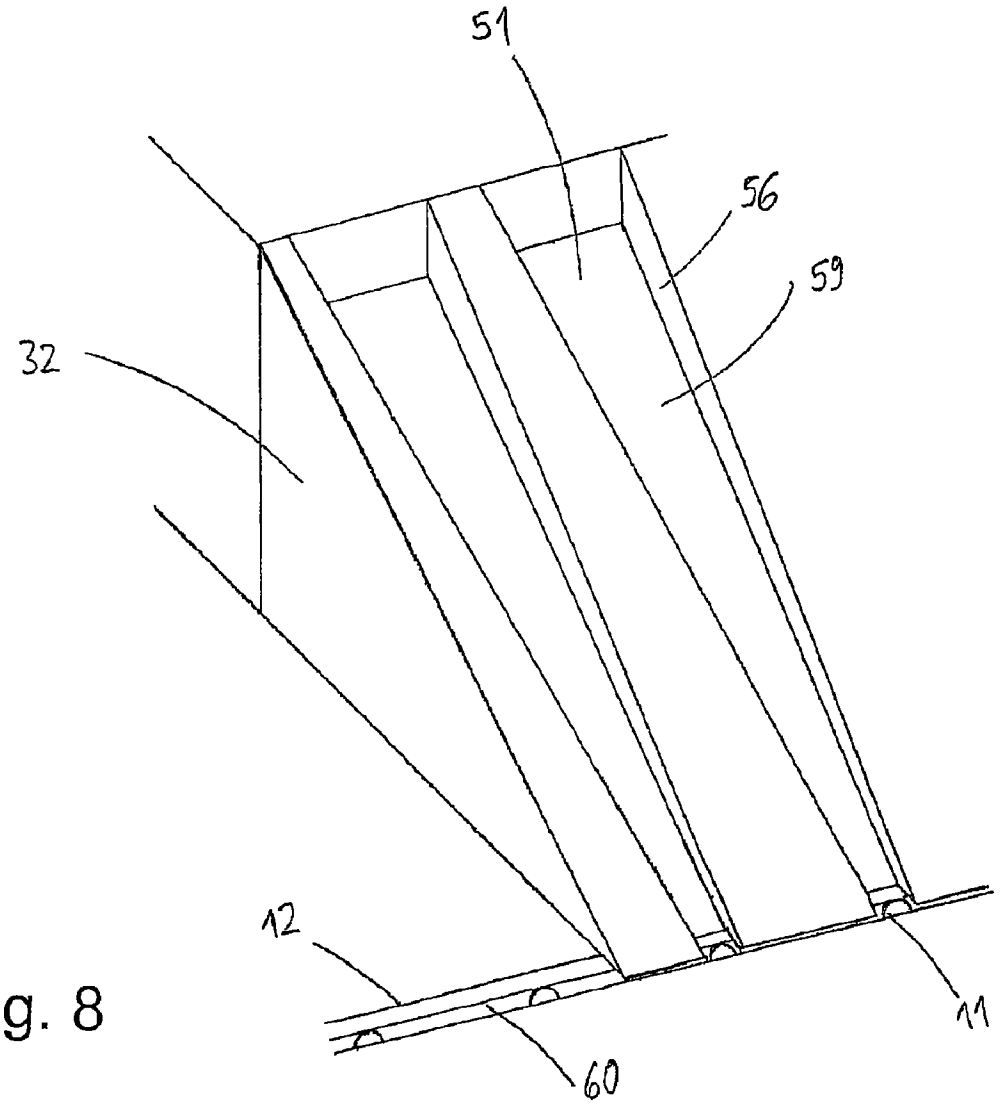
FIG. 8 is a view similar to the one of FIG. 5, of another embodiment of the ledge having yet another geometric configuration of the guide groove.

The needle board 10 that is schematically illustrated in FIG. 2 has a large number of openings or bores 11 that are arranged in many longitudinally extending rows 12, only a few of which being shown in the region of a corner. The division, i.e., the distance between adjacent bores 11 within a row 12, is equal for all rows. Also, the rows among each other are equidistantly arranged from each other at a slightly greater distance. The bores 11 are essentially distributed over the entire surface of the needle board 10. The bores extend essentially at a right angle to the needle board plane and are dimensioned such that, on the one hand, a needle can be pressed into the bore without the risk of any damage and, on the other hand, said needle is securely held when pressed in. The arrangement of the bores in FIG. 2 in longitudinal rows should be viewed only as an example, whereby said arrangement may also be chosen differently, if desired. The rows of bores 12 may be also be arranged in grooves 60, as shown in FIG. 8, for example. The needle board 10 is a thin rectangular plate having a size of, e.g., 1.7 m×0.4 m.

For better illustration, the alignments of the respective arrangements are shown in the figures with the aid of a coordinate system that relates to the needle board plane. In so doing, the x-direction extends to the right in the longitudinal direction of the needle board, when viewed from the viewer's direction in FIG. 1, and the y-direction or transverse direction extends toward the top rear, and the z-direction extends toward the front top at a right angle with respect to the needle board plane.

The automatic loading machine 1 in accordance with FIG. 1 comprises a needle board guide 3 that adjoins a needle board receptacle 2 and enables a shifting of an inserted needle board 10 in longitudinal direction or x-direction. On the side of the needle board receptacle facing the needle board guide 3 there is a bridge-like carrier 5 comprising a pressing device 4 that presses the needles that are initially loosely plugged into the needle board into said needle board. The pressing device 4 can be moved in transverse direction or y-direction across the entire width of the needle board receptacle 2.

The needle board guide 3 may be rigidly attached to the automatic loading machine 1. Said guide has a length such that it carries the needle board if said board is shifted far enough to the left in longitudinal direction that its end located on the right edge is positioned below the pressing device 4 for pressing in the needles. Alternatively, the needle board guide 3 could be designed so it may be slid into the automatic loading machine 1 in a pivotable or telescopic manner.

Figure 3:
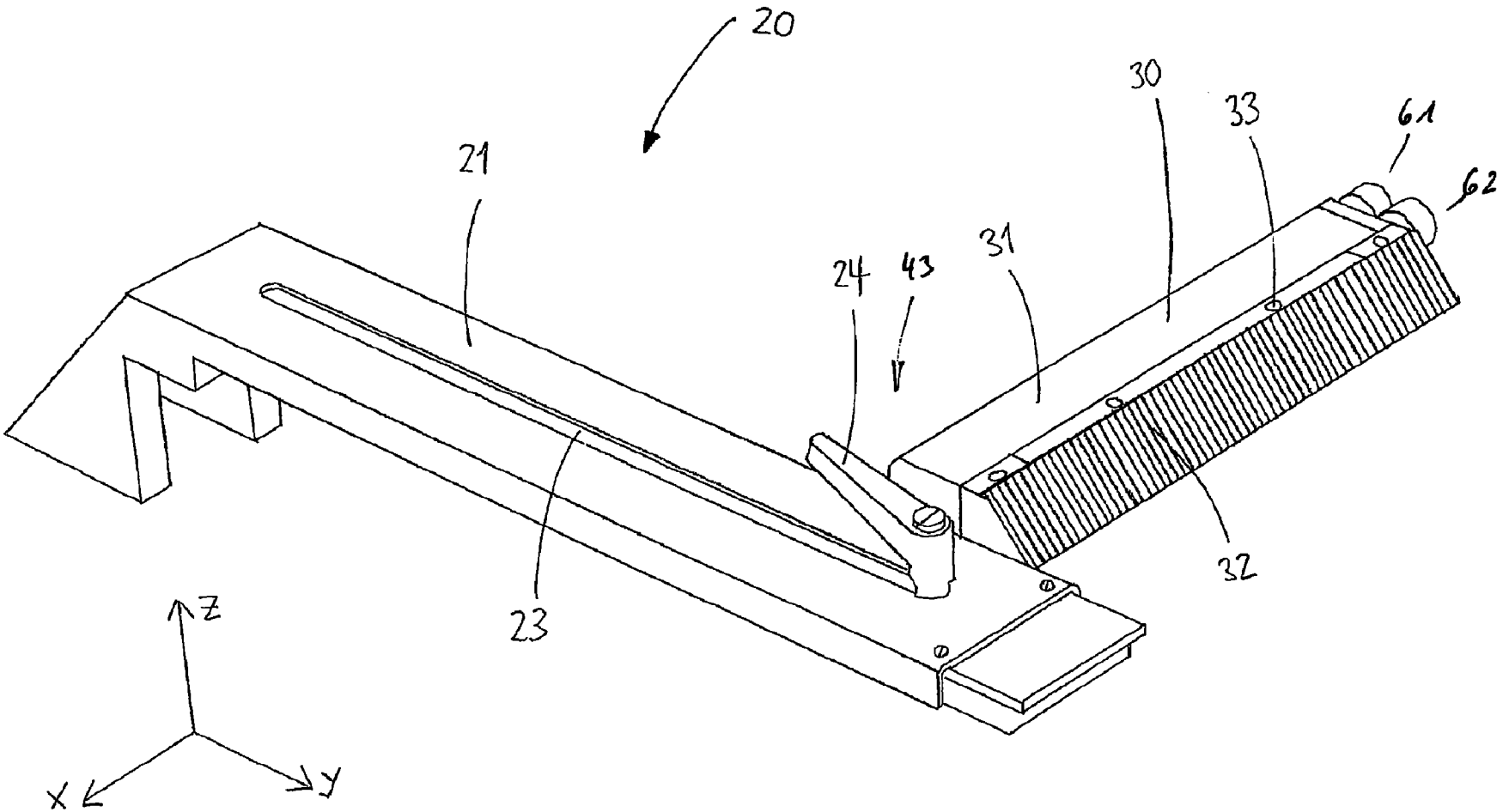
FIG. 3 is an enlarged perspective representation of the insertion arrangement of FIG. 1.

Furthermore, the automatic lauding machine 1 comprises an insertion arrangement 20 that is shown enlarged in FIGS. 3 and 4 and is described hereinafter. The insertion arrangement 20 comprises a holder arm 21 that extends bridge-like in transverse direction of the needle board receptacle 2 and is stationarily arranged on the machine frame of the automatic loading machine 1. Alternatively, the holder 21 can be movably (not illustrated) supported on the machine frame of the automatic loading machine and, in so doing, comprise carrier means such as, for example known guides. A ledge 30 is arranged on the holder arm 21, said ledge extending at a right angle in longitudinal direction and parallel to the rows of bores 12. The ledge 30 can be held in place with the aid of a not specifically shown clamping device 43 that can be released and locked with a lever 24 on the holder arm 21 by the operator. This device enables the operator to simply release the ledge 30 by hand, to shift it, as well as manually lock it in any desired position. The ledge 30 is arranged so as to be movable in the y- and x-directions, relative to the holder arm 21. A longitudinal recess 23 in the holder arm 21 acts as a guide in the y-direction. The ledge 30 remains aligned parallel to the x-direction. The adjustment of the ledge 30 in x-direction occurs via adjustment means that comprise an adjusting spindle 61 as well as linear guide elements. As a result of this, it is possible to adjust the ledge 30 in the range of a few millimeters, preferably +/−10 mm in the x-direction.

During operation, a needle board 10, as shown in FIG. 2, is inserted laterally from the right or the left into the needle board receptacle 2 or the needle board guide 3. For loading, an operator uses the multiple clamping chuck 40—shown enlarged in FIG. 4—to grasp several needles 41 parallel to each other at the distance of the bores 11 and to first plug them loosely into a row 12 of needle board bores. In so doing, the operator utilizes the insertion arrangement 20 in a manner that is described in greater detail in conjunction with the figures hereinafter.

For the insertion of the needles in the desired regions of the needle board 10, said needle board is shifted in longitudinal direction, and/or the insertion arrangement 20 is adjusted as previously described, so that needles 20 can be inserted at the desired location of the needle board with the aid of the insertion arrangement 20. Subsequently, the initially loosely plugged in needles 41 can be pressed firmly into the bores 11 of the needle board 10 with the aid of a pressing device 4. To accomplish this, the operator shifts and/or adjusts the needle board in longitudinal direction, the pressing device 4 in transverse direction, so that the region of the needle board that is to be respectively processed is located under the pressing device 4, and all the needles can be pressed firmly, one after the other, into the corresponding bore in the needle board.

The ledge 30 comprises a carrier element 32 having essentially the configuration of a parallelepiped that extends in the x-direction. Furthermore, the ledge 30 comprises a guide section 32 extending parallel to the carrier element 32 and being connected to said carrier element. The guide section 32 adjoins the carrier element 31 and is detachably connected therewith. With the use of screws 33, the guide section 32 is held on the carrier element 31 and can be removed by being released and interchanged. The guide section 32 is arranged so as to be adjustable in z-direction relative to the carrier element 31 on said carrier element. To do so, the guide section 32 comprises adjustment means that comprise an adjusting spindle 62 as well as linear guide elements. This enables the adjustment of the guide section 32 relative to the carrier element 31 in the range of a few millimeters, in particular of +/−5 mm. As a result of this, the distance of the guide section 32 from the needle board 10 that is to be loaded can be variably determined. As a result of the fact that the guide section 32 can be detached from the carrier element 31 it is possible, when different types of needle boards are being used, to utilize a guide section 32 that is suitable for the respective needle board. The design of the guide section 32, which is described hereinafter, is adapted, in particular, to the design of the needle board bores 22 in view of, for example, bore diameter and bore distances.

Figure 4:
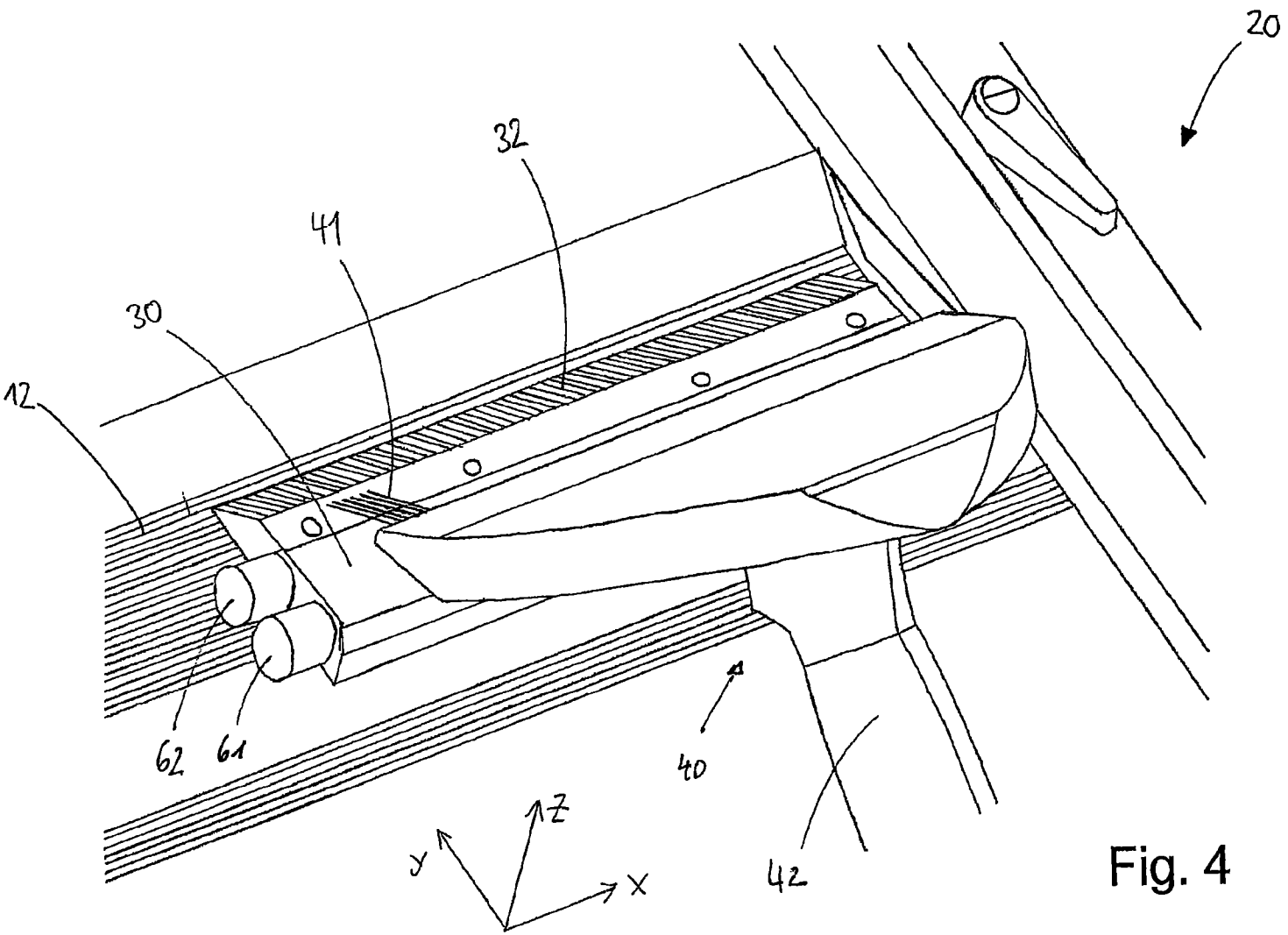
FIG. 4 is a perspective representation of the use of the inventive insertion arrangement as in FIG. 1, when several needles are being inserted in a needle board mounted in a multiple clamping chuck.

FIG. 4 shows the ledge 30 of the insertion arrangement 20 on an enlarged scale, viewed from the perspective of the operator who stands in front of the automatic loading machine 1 and looks at the needle board. A manually guided multiple clamping chuck 40 having a handle 42, in which only a few needles 41 are mounted, is shown. Although FIG. 4 shows only a few needles 41, the clamping chuck 40 may contain substantially more needles such as, for example, a row of needles that can be mounted almost across the entire width of the clamping chuck. The ledge 30 extends along the length that is slightly greater than the width of the multiple clamping chuck 40, so that all the needles of a fully loaded clamping chuck 40 can be inserted at the same time.

The needles 41 are clamped essentially parallel to each other and, without axial offset, next to each other by not visible clamping chucks. The distance of the needles 41 corresponds to the division of the needle board 10, said distance being prespecified by the distances of the bores within a row of bores 12 of the needle board. FIG. 4 shows the bores not individually but only in rows 12. The clamping chuck 40 comprises a not-illustrated actuation device that enables the operator to open and close the clamping jaws in order to be able to simultaneously release or hold a number of needles. The clamping chuck 40 contains not illustrated spring elements that hold the needles in mounted state until the operator opens the clamping chuck and releases the needle by active actuation of a handle. With the aid of the clamping chuck 40, the needles can be removed from a not illustrated filling device, said device offering a number of needles from a needle supply to the operator in the desired parallel arrangement, as described, e.g., in EP 07 002 360.

After the needles 41 have been set in the multiple clamping chuck 40 in order to clamp them therein, the operator inserts the needles, with the aid of the clamping chuck, simultaneously in several bores 11 in a row 12 of the needle board. 10. In so doing, he is aided by the guide section 32 of the illustrated insertion arrangement 20 in the manner described hereinafter.

Figure 5:
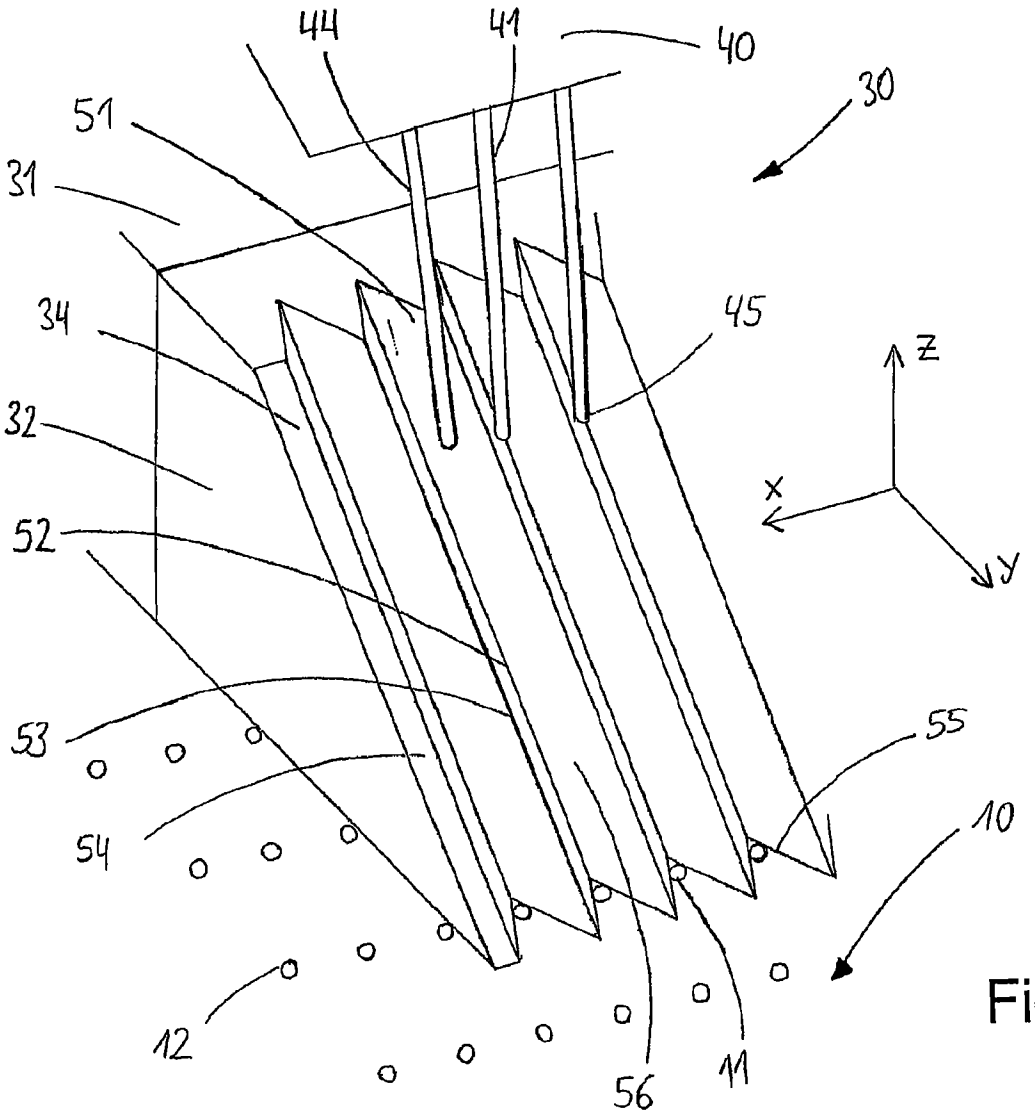
FIG. 5 is an enlarged perspective representation of one end of the ledge of the inventive insertion arrangement of FIG. 3, when several needles are being inserted.

FIG. 5 shows an end of the ledge 30 in accordance with one embodiment of the present invention in a perspective view on an enlarged scale. The guide section 32 provided on the carrier element 31 has the shape of a trapezoidal prism. Many parallel grooves 51 are arranged in an equidistant manner on said prism's downward sloping upper surface 34, said grooves being at the same distance as the bores 11 of a row 12. The grooves 51 have a cross-section in the form of an equilateral triangle and, consequently, form a symmetrical V-shaped groove that narrows in depth. The direction of the edge 52 on the bottom of the groove 51 extends parallel to the upper surface 34, as a result of which the groove 51 has a constant cross-section along its entire length. Adjacent grooves adjoin each other on the edges 53, whereby, alternatively, it is also possible for intermediate sections similar to one edge section 54 to be present in the upper surface 34 between the grooves 51.

On its end that tapers to a point, the guide section 32 forms a comb-like structure with a zigzag edge 55. The guide section 32 can be manufactured, e.g., including the grooves 51 in one piece, e.g., it may be cast. Alternatively, the grooves may be applied later, e.g., by cutting processes. If the guide section 32 has a zigzag edge 55 on its end that tapers to a point, it is necessary for handling that the first ledge 30 can be moved with the carrier element 31 and the guide section 32 at least by the needle diameter in the y-direction, so that the needle board 10 with the needles 41 that have not been completely pressed into the needle board 10 can be shifted in the x-direction. To do so, the ledge 30 may comprise an additional adjustment mechanism (not shown) that is different from the lever 24 and the recess 23. The adjustment of the ledge 30 can be achieved in that a spring force is overcome, said spring force returning the ledge again into the starting position after the needle board 10 has been shifted.

The insertion arrangement in accordance with the invention enables the simultaneous insertion of a plurality of needles 41 that are mounted in a multiple clamping chuck. Said insertion arrangement prevents that already a few misaligned needles—or even only one single misaligned needle—prevent a simultaneous insertion of all the mounted needles into the corresponding bores, which would make a tedious insertion by hand necessary.

FIG. 5 shows a plurality of needles mounted in the clamping chuck 40, whereby the needle 44 farthest on the left is wrongly aligned, while the remaining two needles 41 are arranged parallel in the desired manner. When attempting to insert the needles 41, 44 directly into the bores 11, the needle 11 farthest to the left would miss the associate bore, and the process of simultaneous insertion would fail. The affected needle 44 would have to be removed first, e.g., and then be re-inserted by hand.

In contrast, the insertion arrangement 32 in accordance with the invention enables a simultaneous insertion of all mounted needles 41, 44. To accomplish this, the ledge 30 of the insertion arrangement is arranged and held in place in such a manner that the guide channels formed by the grooves 51 extend centrally to respectively one bore 11 of the needle board 10. The operator now guides the multiple clamping chuck 40 in such a manner that all the needles 41, 44 extend from the top with their tips 45 into the associate grooves 51. In so doing, by exerting a pressure, each of the needle tips may be arranged on the edges 52 at the bottom of the grooves 51. In so doing, the wrongly aligned needle 44 experiences—on one of the inclined lateral surfaces 56 of the groove—a centering force that also forces said needle, while bending it slightly, into the central position. In this manner the clamping chuck 40 can be guided in such a manner that all the needle tips 45 are brought into contact with the respective grove 51 and slide in another movement along the inside of the groove and reach the bores 11 at the same time.

Now, with the aid of the clamping chuck 40, the operator may bring the needles 41, 44 into a vertical position, plug them a certain distance into the bores 11, and release the needles 41, 44 by opening the clamping chuck 40 and thus leave them in the needle board 10. In addition to a positional error of a needle 44 in the x-direction, it is also possible to correct a deviation in the z-direction. By guiding the multiple clamping chuck with a force of pressure exerted from above on the needles, it is possible in this case to achieve a common guiding of all the needle tips along the edge 52 on the bottom of the respective groove 51 and thus achieve a simultaneous insertion in the bore 11.

FIGS. 6 through 9 show—similar to FIG. 5—representations of other embodiments of the guide section 32 of the insertion arrangement 20, so that, regarding communalities, reference is being made to the description of FIG. 5.

Figure 6:
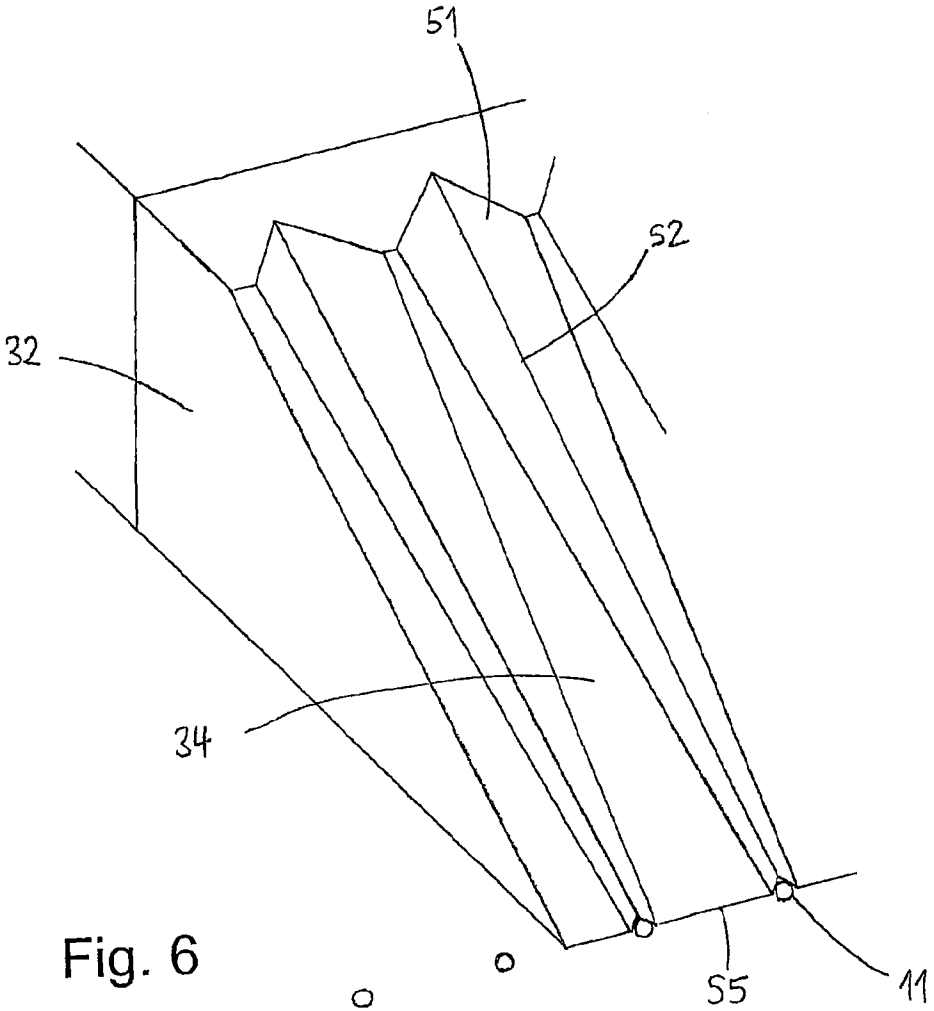
FIG. 6 is a view similar to the one of FIG. 5, of another embodiment of the ledge having a different geometric configuration of the guide groove.

The embodiment shown in FIG. 6 also shows the grooves 51 as having a cross-section in the form of an equilateral triangle, whereby the cross-section of each groove, however, decreases toward the ledge 55 of the guide section 32 that tapers to a point. The remaining minimal groove cross-section is intended for the accommodation of respectively one of the bores 11. As a result of this a structure is created that has on the edge 55 of the guide section 32 that tapers to a point, a largely straight configuration. As a result of this a comb-structure that might be damaged or cause damage when handled is avoided. The groove 51 with the cross-section changing along its length can be produced, e.g., in that a groove is applied by a cutting process, said groove extending not parallel to the upper surface 34. Rather, the edge 52 on the bottom of the groove 51 approaches the upper surface 34 as the groove progresses toward the edge 55.

The insertion of the needles occurs in the manner as described with reference to FIG. 5. In so doing, the permissible positional deviations of the needles continue to be defined by the width of the grooves 51 in their wider region, whereby the width of the grooves 51 is measured at a right angle to the edge 52 and, for example, comprises the distances of two edges 53. In order to guide the needle tips in the direction of the bore 11, also the narrower lower groove section is adequate, once the needles have been received in the grooves 51, and provided that they are held—optionally being biased—in the grooves with the aid of the multiple clamping chuck.

Figure 7:
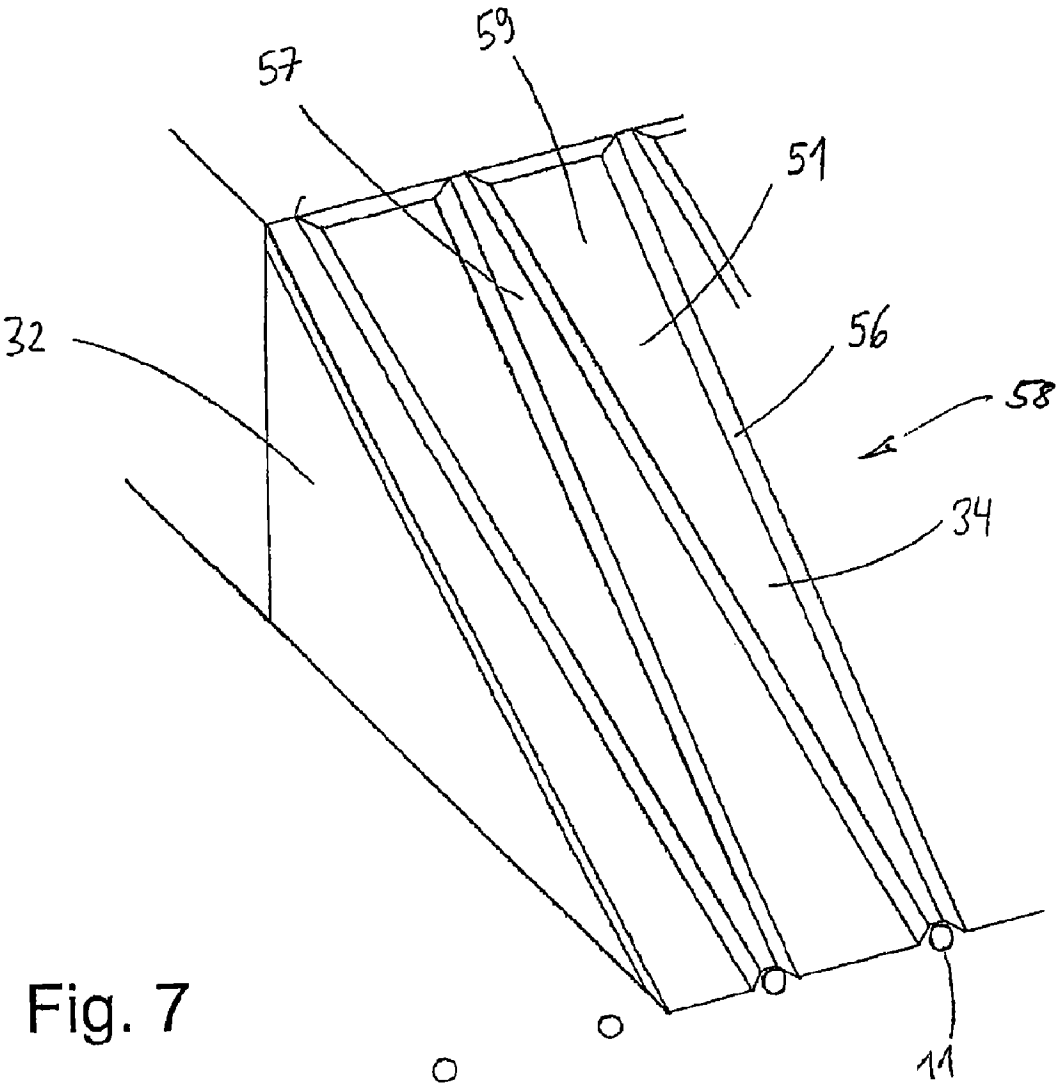
FIG. 7 is a view similar to the one of FIG. 5, of another embodiment of the ledge having another geometric configuration of the guide groove.

FIG. 7 shows another embodiment of the guide section 32 of the insertion arrangement 20 in accordance with the present invention. Grooves 51 are also provided on the upper surface 34, said grooves having a cross-section tapering only in width but not in depth. The grooves have lateral surfaces 56 that are inclined and have a bottom 59 that is parallel to the upper surface, and thus said grooves have a trapezoidal cross-section. In this exemplary embodiment, the grooves 51 are provided in that the plate elements 57 have been applied to a prism-shaped base body 58. This is accomplished by bonding with glue, but could also be done in another way. The needles are inserted, as previously described, in such a manner that the tips of all the needles that have been mounted in the clamping chuck are brought into contact with the bottom 59 of the grooves in the wider upper sections of the respective groove 51. During the guiding process toward the bores 11, the tapering grooves 51 effect the optionally required centering of the needle tips by the lateral surfaces 56.

FIG. 8 shows another exemplary embodiment, wherein the grooves 51 have a rectangular cross-section that narrows toward the bore in width, as well as in depth. The inclined groove surfaces having the centering effect may be omitted if the grooves 51 are wide and deep enough so that all the middle tips can be accommodated in the upper wider region of the grooves 51. The optionally required centering of the needles that deviate from the desired direction is achieved, in this case, during the approach of the needle tips toward the bores 11 through the narrowing perpendicular lateral surfaces 56 or through the force of the abutment pressure on the groove bottom 59. Alternatively, the arrangement shown in FIG. 8 may also be implemented with a constant groove depth.

In accordance with the embodiment of the needle board show in FIG. 8, the bores 11 of each row 12 are arranged recessed in a groove 60. Despite the existing distance between the guide section 32 and the bore 11, the insertion is easily possible if the needles are held in the clamping chuck at a right angle relative to the needle board and, optionally are held, slightly biased, in the ends of the grooves 51.

Figure 9:
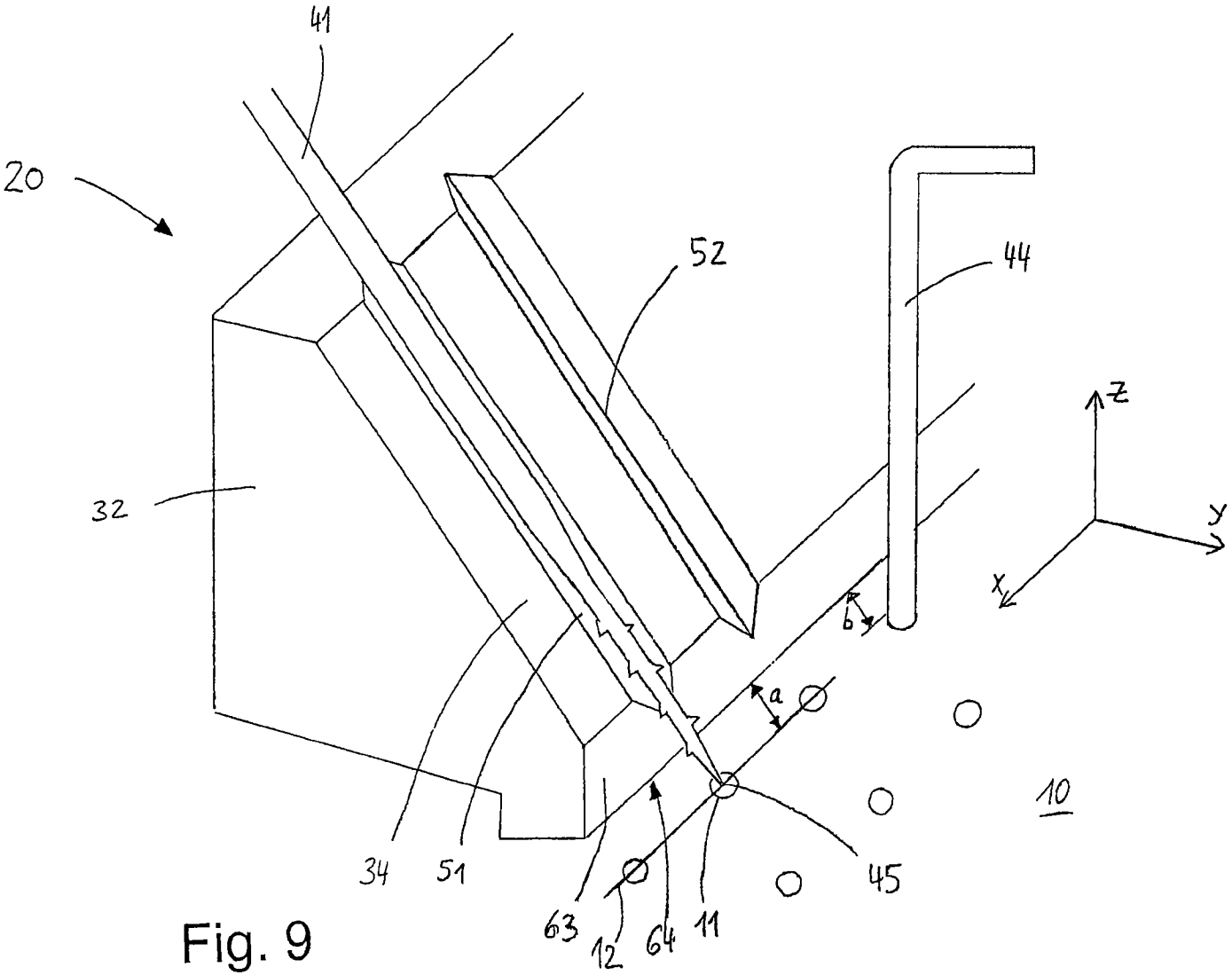
FIG. 9 is an enlarged perspective representation of another exemplary embodiment of an insertion arrangement.

FIG. 9 shows another embodiment of the guide section 32 of the insertion arrangement in accordance with the present invention. Grooves 51 corresponding to the shape and configuration of the previously described geometric configurations, and deviating therefrom, are also provided on the upper surface 34. In contrast with the previously described guide sections, the guide section 32 of the insertion arrangement in accordance with FIG. 9 is delimited by a narrow end face 63 arranged at an angle relative to the surface 63. Preferably, the narrow end face 63 is arranged in such a manner that it extends perpendicularly to the needle board 10 when the insertion arrangement is in use. As a result of this, the guide section 32 at the end that is assigned to the rows 12 of bores 11 has a flattened end 64. The grooves 51, in particular the edges 52, terminate in the narrow face 63 that is preferably configured as an end face. The recesses 51 and, optionally, their edges 52 terminate at the end face 63 above and at a distance from the needle board 10.

When in use, an insertion arrangement 20 comprising a guide section 32 in accordance with FIG. 9 must be applied at a distance 'a' from a row 12 of bores, so that the tip 45 of a needle 41 finds its associate bore 11. This has the advantage that the needle board 10 can be moved in the x-direction, without the inserted needles 44 colliding with the recesses of the insertion arrangement, as is shown on the insertion arrangements with ends 64 that taper toward a point. As is shown by FIG. 9, a distance 'b' exists between the narrow end face 63 of the carrier element 32 and the needle 44 inserted in a bore, said distance 'b' being smaller by half a diameter of the bore 11 than the distance 'a'. Due to the distance b, it is possible to load a complete row of bores 12 with the insertion arrangement 20, without requiring a change of the position of the insertion arrangement. During the loading process, the guide section 32 of the insertion arrangement 20 can guide only a part of the needles 41 of a row of needles due to its length. After these needles 41 have been inserted, the needle board 10 is shifted in the x-direction in order to insert additional needles. This process is repeated until a row of bores 12 is completely loaded with needles. Thereafter, the insertion arrangement 20 may be offset and the next row 12 of bores may again be provided with needles 41 by means of several insertion operation.

An insertion arrangement 20 is provided, said insertion arrangement making it easier for an operator to insert several needles 41, 44 clamped in a multiple clamping chuck 40, even in the case of certain positional deviations, simultaneously in the associate bores 11 of a needle board 10. The insertion arrangement 20 comprises a guide section 32 with many parallel grooves 51 that are arranged at the distance of the bores 11, and that, respectively, can accommodate the tip 45 of a needle 41, 44 and can guide said tip to the associate bore 11. In so doing, the grooves 51 help align the individual needles 41, 44 with respect to the bores 11 in that said grooves correct potential positional deviations by slightly bending the needles 41, 44. The insertion arrangement 20 is mounted to an automatic loading machine 1 and can be adjusted and locked relative to a needle board 10 accommodated in said automatic loading machine.

It will be appreciated that the above description of the present invention is susceptible to various modifications, changes and modifications, and the same are intended to be comprehended within the meaning and range of equivalents of the appended claims.

LIST OF REFERENCE NUMBERS

1 Automatic loading machine
2 Needle board receptacle
3 Needle board guide
4 Pressing device
5 Carrier
7 Housing
10 Needle board
11 Bore
12 Row
20 Insertion arrangement
21 Holder arm
23 Recess
24 Lever
30 Ledge
31 Carrier element
32 Guide section
33 Screw
34 Surface
40 Multiple clamping chuck
41 Needle
42 Handle
43 Clamping device
44 Needle
45 Tip
51 Groove
52 Edge
53 Edge
54 Edge section
55 Edge
56 Lateral surface
57 Plate element
58 Base body
59 Bottom
60 Groove
61 Adjusting spindle
62 Adjusting spindle
63 End face
64 End

What is claimed is:

1. Insertion arrangement (20) for the insertion of at least one needle (41, 44), said needle being clamped in a multiple clamping chuck (40), into a needle board (10) having several bores (11) for accommodation of needles (41, 44), wherein the insertion arrangement (20) comprises at least one recess (51) for the accommodation of at least one needle (41, 44), and wherein the recess (51) is arranged in such a manner that it is suitable for guiding the at least one needle (41, 44) into an associate bore of several bores (11).

2. Insertion arrangement (20) as in claim 1, wherein said insertion arrangement is provided with at least three recesses (51) that are arranged equidistant from each other in a longitudinal direction (x) at a distance corresponding to a division of the bores (11) of an associate needle board (10).

3. Insertion arrangement (20) as in claim 1, wherein at least one recess comprises a groove (51), said groove being provided on a surface (34) of the insertion arrangement (20) and extending up to an edge (55), whereby several grooves (51) extend parallel to each other.

4. Insertion arrangement (20) as in claim 3, wherein the width of the at least one groove (51) decreases as said groove progresses toward the edge (55).

5. Insertion arrangement (20) as in claim 3, wherein the depth of the at least one groove (51) decreases as said groove progresses toward the edge (55).

6. Insertion arrangement (20) as in claim 3, wherein a cross-section of the at least one groove (51) narrows, starting from the surface (34) of the insertion arrangement (20), as it deepens.

7. Insertion arrangement (20) as in claim 6, wherein a cross-section of the groove (51) is trapezoidal or triangular.

8. Insertion arrangement (20) as in claim 1, wherein said insertion arrangement has a guide section (32) with an end face (63).

9. Insertion arrangement (20) as in claim 1, wherein said arrangement comprises a ledge (30) being fastened to a needle board receptacle (2) of an automatic loading machine (1) and extending in longitudinal direction (x).

10. Insertion arrangement (20) as in claim 9, wherein the ledge (30) comprises adjustment means that enable an adjustment in x-direction.

11. Insertion arrangement (20) as in claim 10, wherein the guide section (32) is associated with the ledge (30) and is held relative to this ledge (30) so as to be height-adjustable.

12. Insertion arrangement (20) as in claim 11, wherein the ledge (30) can be adjusted in transverse direction (y) relative to the holder arm (21) and can be fixed in its position by means of a clamping device (43).

13. Insertion arrangement (20) as in claim 11, wherein the holder arm (21) can be adjusted in longitudinal direction (x) relative to the automatic loading machine (1) and can be fixed in its position.

14. Insertion arrangement (20) as in claim 9, wherein said insertion arrangement has a removable guide section (32) that is adapted to the needle board type (10) and has recesses (51) that match the bores (11) of said needle board type.

15. Insertion arrangement (20) as in claim 9, wherein said insertion arrangement comprises a holder arm (21), on which the ledge (30) is held and which extends in a transverse direction (y) at a right angle with respect to the longitudinal direction (x).

* * * * *